United States Patent [19]

La Volpa

[11] 4,422,364

[45] Dec. 27, 1983

[54] FIPPLE TYPE HEADJOINT ASSEMBLY FOR USE WITH EXISTING TRANSVERSE FLUTES

[76] Inventor: Joseph R. La Volpa, 435 Bosley St., P.O. Box 369, Santa Rosa, Calif. 95402

[21] Appl. No.: 282,143

[22] Filed: Jul. 10, 1981

Related U.S. Application Data

[63] Continuation of Ser. No. 117,527, Jan. 31, 1980, abandoned.

[51] Int. Cl.[3] ..... G10D 7/02

[52] U.S. Cl. ..... 84/384

[58] Field of Search ..... 84/380 R, 380 C, 384

[56] References Cited

U.S. PATENT DOCUMENTS

| | | | |
|---|---|---|---|
| 920,471 | 5/1909 | Jenner | 84/384 |
| 2,330,379 | 9/1943 | Powell | 84/384 |

FOREIGN PATENT DOCUMENTS

| | | | |
|---|---|---|---|
| 781746 | 5/1935 | France | 84/384 |
| 692491 | 7/1953 | United Kingdom | 84/380 C |

*Primary Examiner*—Lawrence R. Franklin

*Attorney, Agent, or Firm*—Flehr, Hohbach, Test, Albritton & Herbert

[57] ABSTRACT

A flute employing a fipple type mouthpiece assembly permits the flute to be more easily mastered.

2 Claims, 3 Drawing Figures

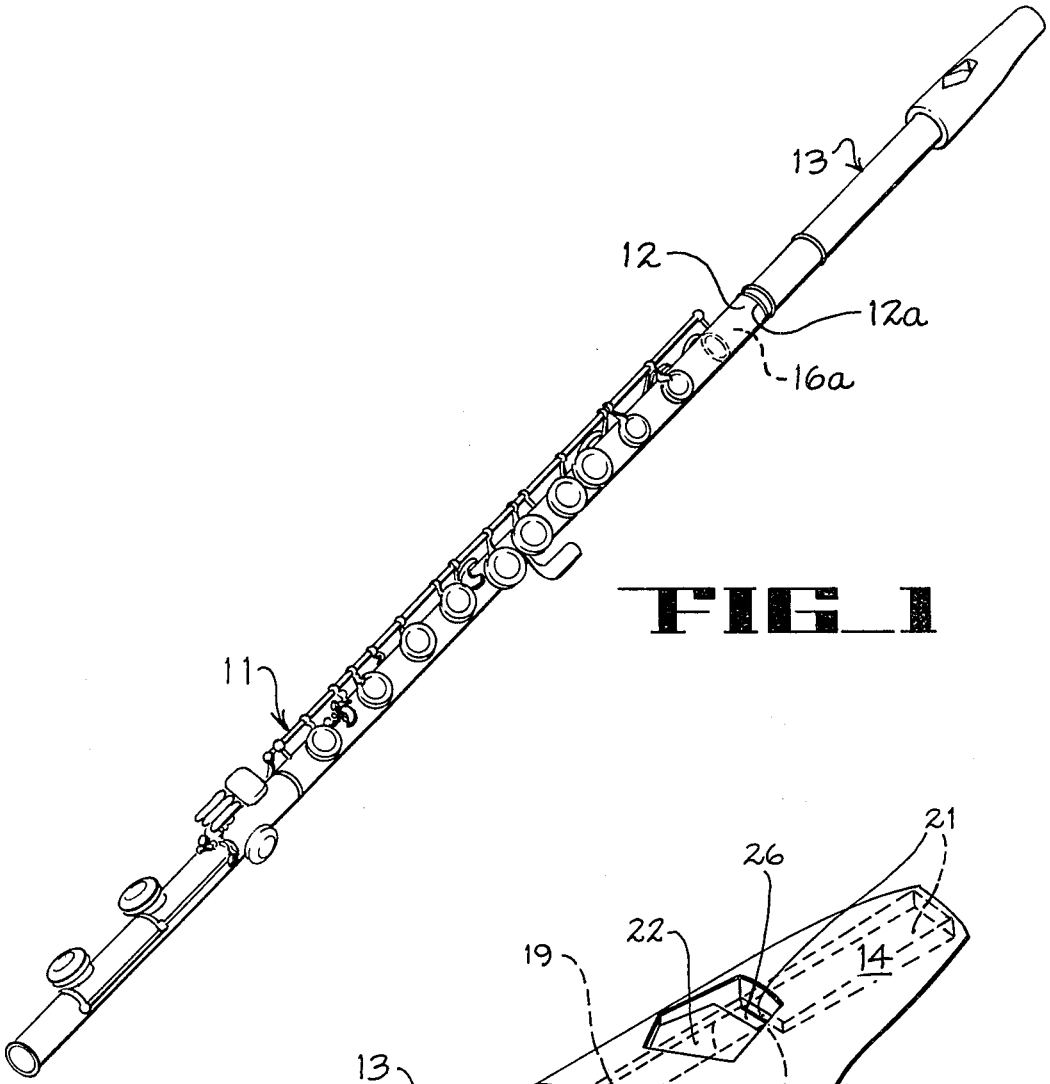
FIG_1
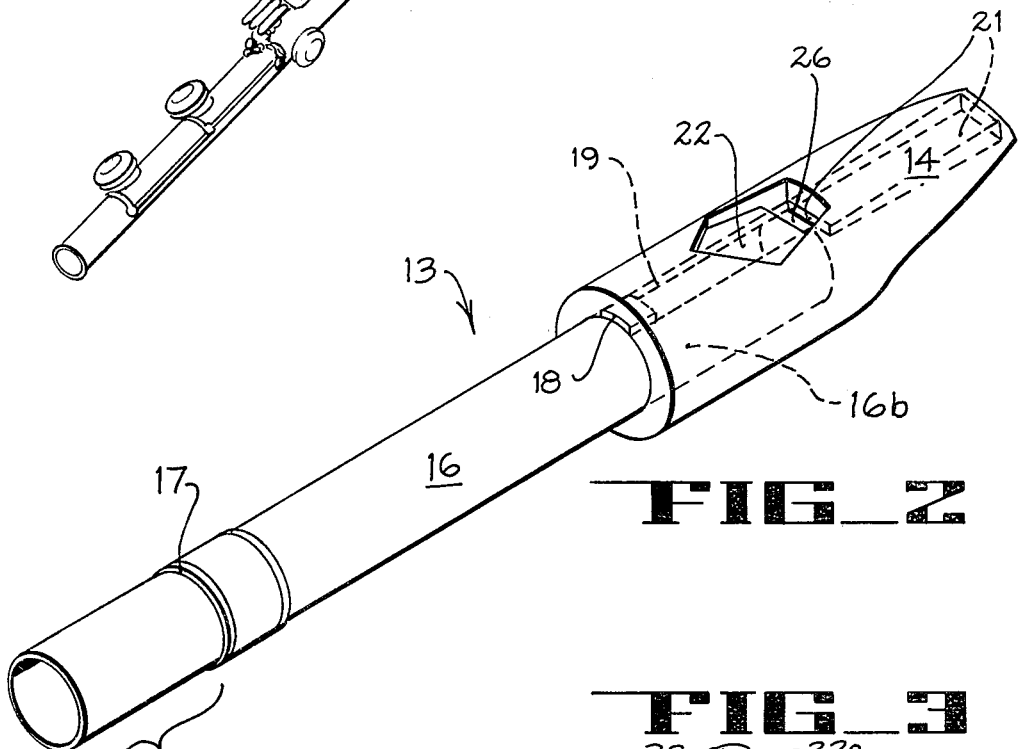
FIG_2
FIG_3
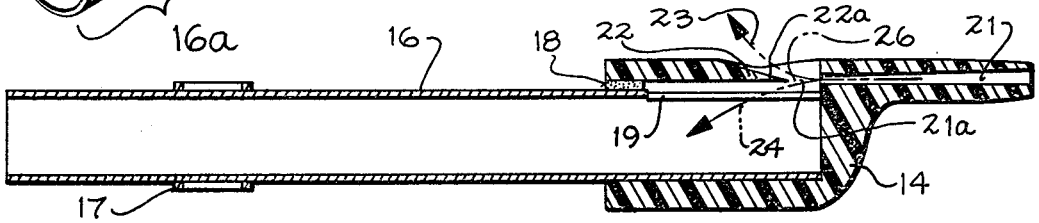

FIPPLE TYPE HEADJOINT ASSEMBLY FOR USE WITH EXISTING TRANSVERSE FLUTES

This is a continuation of application Ser. No. 117,527 filed Jan. 31, 1980, now abandoned.

This invention pertains to a flute with a fipple type mouthpiece assembly.

Typically flutes are played employing a cross-blown mouthpiece which requires the flute to be supported by both hands of the musician so that the flute extends laterally from the player's mouth.

This awkward positioning of the flute as well as the cross-blown mouthpiece causes the flute to appear to be difficult to play. Accordingly, these features have caused the flute to be one of the least popular musical instruments chosen by children and other beginners.

In general, as disclosed herein, a flute is provided with a mouthpiece assembly employing a fipple type mouthpiece element and an elongate, tubular member having an outside diameter slightly less than the inside diameter of the tubular playing end of the flute so as to permit the tubular member to be inserted into the flute with a sliding fit after removal of the usual cross-blown mouthpiece. A rib extends around the tubular member to engage the outer end edge of the flute at a position sufficiently displayed from the inserted end to permit the flute to support the assembly therefrom.

The other end of the tubular member is inserted and fixed within the fipple type mouthpiece.

In general, it is an object of the present invention to provide a flute with an improved mouthpiece arrangement to encourage beginners and others to play the flute. Also, this mouthpiece makes it considerably easier to learn to play the instrument.

It is another object of the present invention to provide an improved mouthpiece assembly which can be physically interchanged with the usual cross-blown mouthpiece while at the same time providing a somewhat different tone.

The foregoing and other objects and features of the invention will become more readily evident from the following detailed description of a preferred embodiment when considered in conjunction with the drawings.

FIG. 1 shows a diagrammatic perspective view of a flute equipped with a fipple style mouthpiece according to the invention; and FIG. 2 shows an enlarged diagrammatic perspective view of a fipple type mouthpiece assembly according to the invention.

FIG. 3 shows an elevation, centerline section view of FIG. 2.

As shown in FIG. 1, an elongate flute portion 11 with its usual keys and vents includes an open upper end 12 formed with a rolled edge 12*a* therearound. A mouthpiece assembly 13 as shown best in enlarged detail in FIG. 2 includes a fipple type mouthpiece element 14 and an elongate, tubular member 16 having an outside diameter slightly less than the inside diameter of the playing ene of flute portion 11 so as to permit the tubular member 16 to be inserted therein with a sliding fit upon removal of the usual cross-blown mouthpiece.

A rib 17 extending around tubular member 16 serves to engage the outer end edge 12*a* of flute portion 11 at a position sufficiently displaced along the inserted end to permit the inserted portion 16*a* to be engaged in the inner edge margin of flute portion 11 to support the assembly 13 therefrom.

The other end portion 16*b* is inserted and fixed within the fipple type mouthpiece 14 as by suitable means such as cement 18 or the like.

End portion 16*b* includes an elongate slot 19 disposed along the top surface of tubular member 16 for passing a portion 24 of the wind blown into mouthpiece 14 as shown best in FIG. 3.

Accordingly, mouthpiece 14 includes an air blow hole 21 in which the top and bottom surfaces converge progressively inwardly of the blow hole 21. Accordingly, blow hole 21 is tapered progressively inwardly whereby the mid-plane of the discharge end 21*a* lies substantially in the plane of the tip 22*a* of the air deflection wedge 22 so that the inward flow of air represented by phantom lines 23, 24 can be split by wedge 22 to bisect the incoming air flow for initiating the sound to be ultimately modulated by the playing of the keys of the flute.

The air flow 23 is discharged upwardly through the opening 26 while air flow 24 is similarly discharged downwardly through passage 19 to pass through the hollow interior of tubular member 16 having a uniform cross-section throughout.

From the foregoing it will be readily evident that there has been provided an improved flute and mouthpiece assembly which serves to provide more encouragement to young players and other beginners whereby it can be played in a more normal position in front of the players.

I claim:

1. A fipple headjoint construction for a flute comprising an elongate metal tubular member, one end of said tubular member including an elongate air passage formed through the side wall of said tubular member, a non-metallic fipple mouthpiece element having a wind opening therein formed through the side wall of said mouthpiece element, said element being mounted onto said one end of said tubular member, said one end being inserted into said mouthpiece to a degree at least coextensive with the position of said wind opening to form a metal liner within said mouthpiece, said mouthpiece element including an elongate flow passage having outer and inner ends thereof and extending from the outer end of the mouthpiece element to said inner end of the flow passage, said inner end of said flow passage being disposed adjacent said inserted end of said tubular member, an air deflection wedge disposed in confronting spaced relation to the inner end of said flow passage, said wind opening being disposed between said inner end of said flow passage and said wedge for permitting a portion of the entering air to escape through said wind opening, said elongate air passage formed through the side wall of said one end of said tubular member extending along said member to a position substantially beyond said wedge to provide a metallic liner within said mouthpiece element, said wedge serving to deflect a first portion of the entering air to pass downwardly into said tubular member and against said liner via said elongate air passage and for deflecting a second portion of the entering air to discharge upwardly and outwardly via said wind opening to initiate sound waves into the flute.

2. A headjoint for a flute including a non-metallic fipple mouthpiece of a type having a wind opening formed to extend laterally therethrough, a flow passage extending along said mouthpiece for discharging wind from the inner end thereof into the region of said wind opening, an elongate metal tube, one end portion of said tube being adapted to be received into the barrel of a flute for supplying wind thereto from said mouthpiece, the other end portion of said tube being inserted into said mouthpiece to a degree at least co-extensive with the longitudinal position of said wind opening to form a tubular metal liner within said non-metallic mouthpiece, a slot formed along and through the side wall of said other end portion of said tube, said slot being disposed laterally adjacent said wind opening to form a flow passage for passing wind from said inner end of said mouthpiece onto said metal liner and into the barrel of a flute via said tube.

* * * * *